US007862094B1

(12) United States Patent
Lamont et al.

(10) Patent No.: US 7,862,094 B1
(45) Date of Patent: Jan. 4, 2011

(54) CONTAINER SCOOP AND SCRAPER WITH ERGONOMIC POCKETS FOR FINGERS AND THUMB OF ONE HAND

(76) Inventors: Fiona Lamont, 4974 Middleton Pl., Pleasanton, CA (US) 94566; Orla Michelle Lamont, 4974 Middleton Pl., Pleasanton, CA (US) 94566; Agnes Anne Lamont, 4974 Middleton Pl., Pleasanton, CA (US) 94566; David Xavier Lamont, 4974 Middleton Pl., Pleasanton, CA (US) 94566

( * ) Notice: Subject to any disclaimer, the term of this patent is extended or adjusted under 35 U.S.C. 154(b) by 0 days.

(21) Appl. No.: 12/824,169

(22) Filed: Jun. 26, 2010

(51) Int. Cl.
*B25B 9/02* (2006.01)
*A47L 13/41* (2006.01)

(52) U.S. Cl. ..... 294/55; 294/1.3; 294/25

(58) Field of Classification Search ..... 294/1.3, 294/25, 55; 15/257.6; 229/117.09, 117.12, 229/117.13
See application file for complete search history.

(56) References Cited

U.S. PATENT DOCUMENTS

| | | | | |
|---|---|---|---|---|
| 3,407,927 | A * | 10/1968 | Jones | 206/372 |
| 3,685,088 | A | 8/1972 | Doherty | |
| 4,037,867 | A | 7/1977 | Fano | |
| 4,148,510 | A | 4/1979 | Brack | |
| 4,188,055 | A | 2/1980 | Green | |
| 4,747,633 | A | 5/1988 | Stacy | |
| 4,951,987 | A | 8/1990 | Lebeau | |
| 5,359,840 | A | 11/1994 | Costar | |
| 5,964,488 | A * | 10/1999 | Bedel | 294/1.3 |
| 6,086,123 | A | 7/2000 | Sowinski | |
| 6,871,891 | B2 * | 3/2005 | Rivera Garcia | 294/1.3 |
| 2003/0131393 | A1 * | 7/2003 | Votolato | 2/16 |
| 2009/0278366 | A1 | 11/2009 | Lipscomb | |

FOREIGN PATENT DOCUMENTS

| | | | |
|---|---|---|---|
| DE | 202004013218 | U1 | 1/2005 |
| FR | 2647134 | A1 | 11/1990 |
| GB | 2349559 | A | 8/2000 |
| JP | 9287162 | A | 11/1997 |

* cited by examiner

*Primary Examiner*—Dean J Kramer
(74) *Attorney, Agent, or Firm*—Lyman H. Moulton

(57) ABSTRACT

A container scoop and scraper device operable by a user's fingers and opposing thumb of one hand forms a container around a grasped object or material. The device includes a first arcuate scoop adjoining an elliptical right side to an elliptical left side along a minor arc on both sides, a front edge of the first scoop forms a scraper. The device also includes an ergonomic concave pocket to receive the user's thumb and extends the width of the device. Similarly, a second arcuate scoop is configured to adjoin elliptical sides along a major arc, and form a second scraper. An ergonomic convex pocket receives the user's fingers and also extends the width of the device. A hinge adjoins the first scoop to the second scoop and disposes the first scoop sides adjacent the second scoop sides to form a closed rigid container around a grasped object or materials.

7 Claims, 14 Drawing Sheets

CONTAINER SCOOP AND SCRAPER WITH ERGONOMIC POCKETS FOR FINGERS AND THUMB OF ONE HAND

BACKGROUND

Scoops are used in a variety of ways to gather and store or discard items and materials. Scoops may therefore be designed and constructed in a variety of ways to suit a variety of needs and applications. For instance, hand operated sediment sampling scoops may be used in seabed and continental shelf research. Even automated and detachable caching scoops, such as those of the Mars Rover, are used in soils and sample acquisition of other planets. On the other hand, refuse collection devices including the common dustpan are also used to keep domestic and commercial establishments clean. Scientists and children alike may even use the proverbial glass jar for collecting insects, small animals and plant samples. Furthermore, conscientious pet owners may use scoop devices including simple plastic bags for collecting dog feces in public places to comply with city ordinances and on their own property to maintain sanitary grounds.

However, all of these devices fall short as a ubiquitous and universal device for collecting, gathering, storing and shipping and handling of live, sterile, hot and cold, research items and materials and even common refuse. For instance, though it works well as a storage container for displaying insects, coaxing a frog or a tarantula spider into a glass jar is not an effective way of collecting specimens. On the other hand, though a leather glove may be an easier way to gather and handle an item, it does not of course store items very effectively. More sophisticated devices such as the seabed sediment sampling scoops and the Mars Rover sample acquisition scoops are complex, heavy, expensive and constructed for specialized use and maya not be available to the general public.

SUMMARY OF THE INVENTION

A scoop and scraper operable by a user's fingers and opposing thumb of one hand to form a container around a grasped object and/or materials is disclosed. The container scoop and scraper includes a first arcuate scoop configured to adjoin a substantially elliptical right side to a substantially elliptical left side along a minor arc on both sides, a front edge of the first scoop configured to form a first scraper and a scoop spine configured opposing the first scraper. The container scoop and scraper also includes an ergonomic concave pocket to receive the user's thumb, the thumb pocket configured to encompass the outside of the first scoop and sides.

Similarly, a second arcuate scoop is configured to adjoin a substantially elliptical right side to a substantially elliptical left side along a major arc on both sides, a front edge of the second scoop configured to form a second to scraper and a scoop spine configured opposing the first scraper. An ergonomic convex pocket receives the user's fingers, where the fingers pocket is configured to encompass the outside of the second scoop and sides.

Additionally, a hinge configured to adjoin the first scoop to the second scoop at respective spines is included which disposes the first scoop left and right sides adjacent the second scoop left and right sides to form a closed rigid container around the grasped object and/or materials.

Methods of using and making embodiments of the container scoop and scraper are also included herein.

Throughout the description, similar reference numbers may be used to identify similar elements depicted in multiple embodiments. Although specific embodiments of the invention have been described and illustrated, the invention is not to be limited to the specific forms or arrangements of parts so described and illustrated. The scope of the invention is to be defined by the claims appended hereto and their equivalents.

DETAILED DESCRIPTION

An embodiment of the present disclosure, ICKEASE™, is a combined scoop, scraper and container operated with just one hand that isolates the user's hand from the item being picked up. ICKEASE™ may be used with just one hand to scrape, pick-up and contain any semi-solid or solid item. It isolates the user's hand from the item making it ideal for picking up unpleasant or hazardous items and ensuring that the item is not contaminated by the user's hand. Items that may be scraped and scooped into ICKEASE™ are insects, spiders, mice and lizards and other small animals, sharp items such as nails, glass, discarded syringes, items that should be untouched such as food ingredients including grain, raisins, and bulk products, hot items such as roasted chestnuts, and cold items such as ice cubes and dry ice chunks, sterile items such as laboratory samples or forensic items, and also dog feces.

ICKEASE™ is shaped to fit the hand. The fingers are placed in the device's fingers pocket and the thumb in the rear thumb pocket. The pockets extend the width and sides of the device and accommodate either the right or left hand. The pockets are only open at the top. The narrow, flat top of the device extends to the web between the forefinger and the thumb. The top has one hinge on the front finger side. The rounded, wide bottom of the device opens when the hand is opened and closes when the hand is closed.

Figure 1:
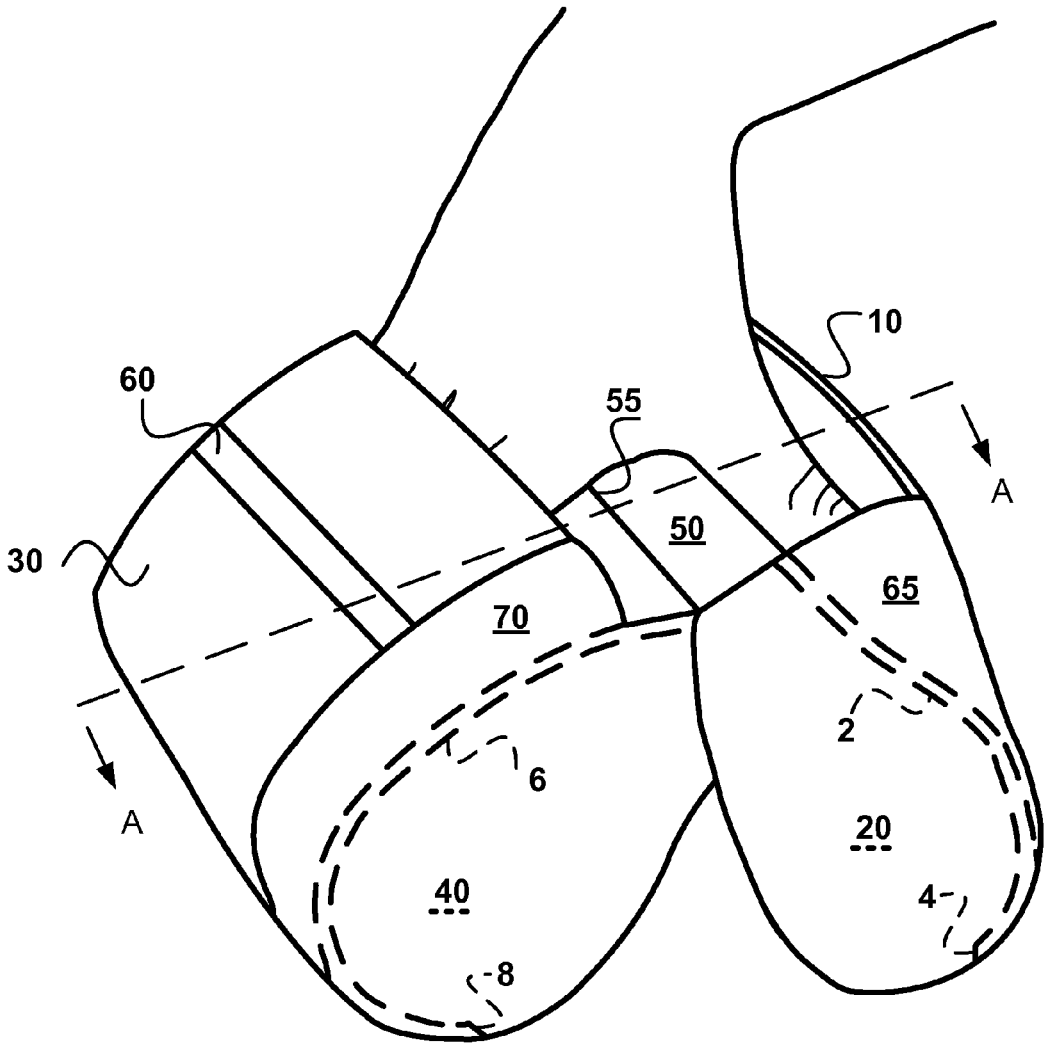
FIG. 1 is a top left perspective view of a container scoop and scraper as held by a user's fingers and opposing thumb of one hand to form an enclosure around a grasped object and/or materials in accordance with an embodiment of the present disclosure.

FIG. 1 is a top left perspective view of a container scoop and scraper as held by a user's fingers and opposing thumb of one hand to form an enclosure around a grasped object and/or materials in accordance with an embodiment of the present disclosure. The container scoop and scraper as depicted includes a first scoop wall 2 and a first scraper 4, a second scoop 6 and a second scraper 8, an ergonomic concave thumb pocket 10, a first scoop left side 20 affixed under the thumb pocket left side 65 supports the first scoop wall 2, a fingers pocket 30, a second scoop left side 40 affixed under the fingers pocket left side 70 supports the second scoop wall 6, a spine 50, a hinge 55 and an adhesive strip 60.

An embodiment of the container scoop and scraper includes the first arcuate scoop wall 2 (shown in dotted line) configured to adjoin a substantially elliptical right side (not depicted) to a substantially elliptical left side 20 along a minor arc on both sides, a front edge of the first scoop wall 2 is configured to form a first scraper 4 and a scoop spine 50 is configured opposing the first scraper 4. The container scoop and scraper also includes an ergonomic concave pocket 10 to receive the user's thumb, the thumb pocket 10 is configured to encompass the outside of the first scoop 2 and both sides. Two points lying on an ellipse define two arcs. The shortest is called the 'minor arc' and the longer one is called the 'major arc'. The two arcs together comprise the circumference of the ellipse.

Similarly, a second arcuate scoop wall 6 (shown in dotted line) is configured to adjoin a substantially elliptical right side (not depicted) to a substantially elliptical left side 40 along a major arc on both sides, a front edge 8 of the second scoop 6 is configured to form a second scraper 8 and a scoop spine 50 is configured opposing the first scraper 8. The first and second scrapers may have beveled edges in embodiments comprising heavy stock material. In embodiments comprising thinner material, the first and second scrapers may not need to be beveled. An ergonomic convex pocket 30 receives the user's fingers, where the fingers pocket 30 is configured to encompass the outside of the second scoop 6 and both sides.

Additionally, a hinge 55 is configured from adjoining the first scoop 2 to the second scoop 6 at respective spines. The hinge 55 also disposes the first scoop left side 20 and right side (not depicted) adjacent the second scoop left side 40 and right side (not depicted) to form a closed rigid container around the grasped object and/or materials.

The scoop sides 20 and 40 (also shown in FIG. 7 and FIG. 8) are overlaid by the pocket sides 65 and 70 respectively. The first scoop side 20 is completely covered by the first pocket side 65 and the second scoop side 40 is completely covered by the second pocket side 70. In flat stock embodiments, the double thickness resulting from the overlaid scoop and pocket sides aids in construction as will be explained further below. The double thickness also lends strength to the flat sides which slide by each other in operation, the first sides receding inside the second sides when the container scoop and scraper is closed as depicted below in FIG. 2.

The left and right sides of both scoops and pockets are configured to extend beyond the first and second scrapers through the full range of grasping motion of the user's fingers and opposing thumb and thereby provide continual and substantial overlap of the first sides with the second sides. Most notably, the minor arc coverage of the first scoop onto the elliptical sides enables the major axis points of the elliptical sides to extend beyond the first scraper in use without inhibiting scraping functions.

The arcuate construction of the first scoop 2 and second scoop 6 give the scoops superior scooping strength and capacity. The major arc of the second scoop 6 ensures that objects and materials gathered by the scoops will be retained at least within the second scoop 6. The disclosed container scoop and scraper is thus able to retain heavy objects relative to its intrinsic weight due to its arcuate construction. Additionally, the arcuate construction supports the scrapers and inhibits buckling and twisting of the scraper ends under torsional forces. The durable container scoop and scraper may therefore be reused many times at the option of the user.

Because it may be made economically, the container scoop and scraper also lends itself to single use and storage as a container. Alternately, an ecologic container scoop and scraper embodiment may be constructed out of biodegradable materials and therefore be easily discarded or recycled.

The ergonomic construction of the thumb and fingers pockets not only facilitates prolonged ease of use by a single hand but also contributes to the strength and durability of the arcuate construction. The human hand requires extra muscle movement and effort to use the fingers and an opposing thumb in convex postures during power gripping. However, a precision grip where the fingertips and the thumb press against each other requires less effort and allows greater control. Therefore, the disclosed ergonomic thumb pocket 10 is shaped into a concavity while the ergonomic fingers pocket 30 is convex shaped to allow precision gripping and ease of use over prolonged periods of time without fatigue and injury. The unique construction of the thumb pocket 10 encompassing the entire first scoop 2 also allows for natural lateral movement of the opposing thumb during opening and grasping movements.

Figure 2:
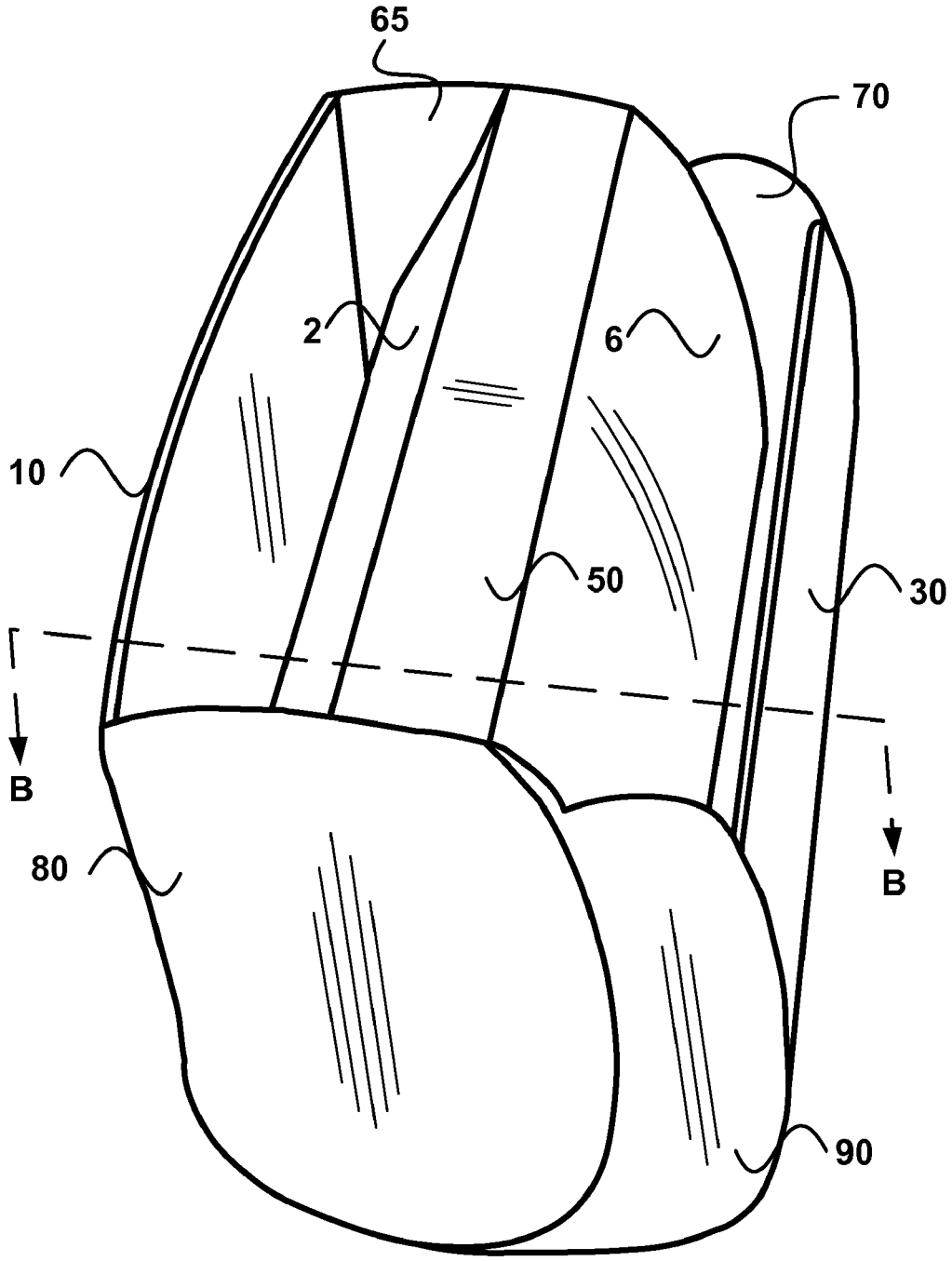
FIG. 2 is a top right perspective view of a closed container scoop and scraper depicting the ergonomic pockets for the user's fingers and thumb of one hand in accordance with an embodiment of the present disclosure.

FIG. 2 is a top right perspective view of a closed container scoop and scraper depicting the ergonomic pockets for the user's fingers and thumb of one hand in accordance with an embodiment of the present disclosure. Shading lines to in FIG. 2 accentuate the substantially flat and curved surfaces of the container scoop and scraper. The container scoop and scraper depicted further includes a thumb pocket right side 80 and a fingers pocket right side 90.

A first scoop right side and a second scoop right side (undepicted) are overlaid by the thumb pocket right side 80 and the fingers pocket right side 90. Though undepicted in FIG. 2, the first scoop right side is identical to the substantially elliptical first scoop left side 20 and the second scoop right side is identical to the substantially elliptical second scoop left side. The respective shapes are depicted in detail in FIG. 7 and FIG. 8 in top plan views before assembly. FIG. 2 illustrates the compact form of the container scoop and scraper when it is closed. It will be later illustrated how this compact and substantially flat exterior allows stacking, and shipping and handling of closed container embodiments.

Figure 3:
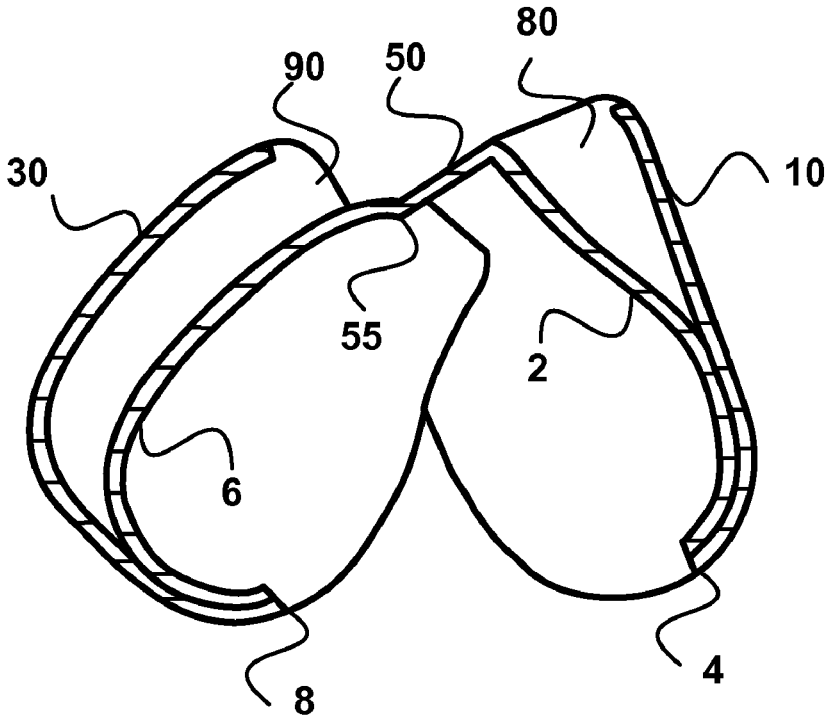
FIG. 3 is a cross-sectional view taken along the line A-A of FIG. 1 depicting opposing scrapping edges in accordance with an embodiment of the present disclosure.

FIG. 3 is a cross-sectional view taken along the line A-A of FIG. 1 depicting opposing scrapping edges in accordance with an embodiment of the present disclosure. This depiction aptly illustrates the convex fingers pocket area and the concavity of the thumb pocket area and how each is formed by respective scoop and pocket walls. It also illustrates the hinge 55 and how the fingers pocket sides recede inside the thumb pocket sides. The thumb pocket and first scoop left sides 65 and 20 and the fingers pocket and second scoop sides 70 and 40 are removed due to the cross section.

Embodiments of the disclosed container scoop and scraper include scoop walls made of low durometer materials to allow the user to perceive and tactilely feel the object or materials being grasped. Such embodiments maintain the rigid container structure of the pockets and sidewalls and therefore preserve the properties of storing and shipping and handling.

Figure 4:
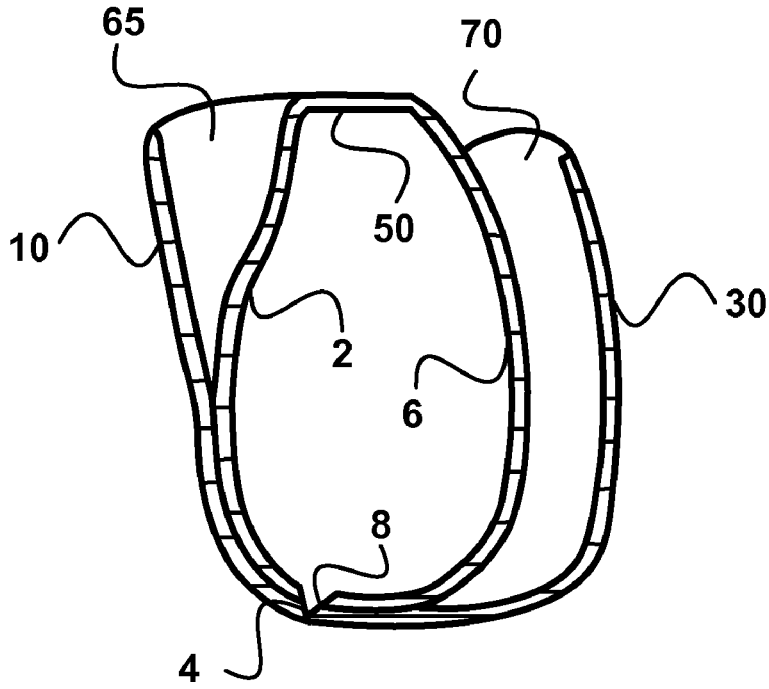
FIG. 4 is a cross-sectional view taken along the line B-B of FIG. 2 depicting the scraping edges in the closed position in accordance with an embodiment of the present disclosure.

FIG. 4 is a cross-sectional view taken along the line B-B of FIG. 2 depicting the scraping edges in the closed position in accordance with an embodiment of the present disclosure. This depiction illustrates the major arc of the second scoop and the minor arc of the first scoop when the first and second scraping edges meet. It also illustrates in a plan view manner the substantially elliptical shape of the interior formed by the first and second scoops and the elliptical scoop sides. The thumb pocket right side 80 and the fingers pocket right side 90 are removed due to the cross section.

Figure 5:
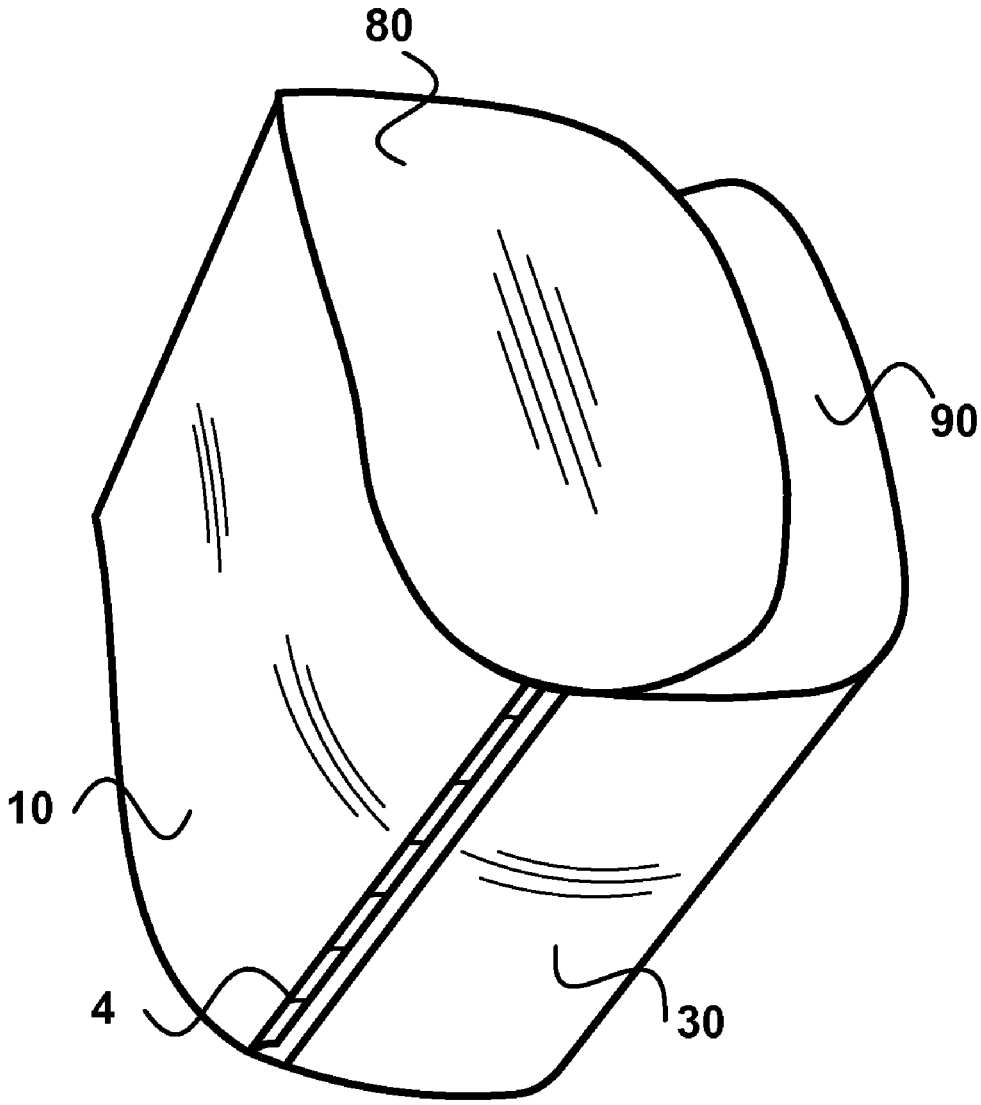
FIG. 5 is a right bottom perspective view of a substantially closed container scoop and scraper depicting a beveled first scraper of the thumb scoop in accordance with an embodiment of the present disclosure.

FIG. 5 is a right bottom perspective view of a substantially closed container scoop and scraper depicting a beveled first scraper of the thumb scoop in accordance with an embodiment of the present disclosure. The first scraper 4 and the second scraper 8 (undepicted) may be comb shaped, crenulated, or serrated to aid in scraping and collecting the object or materials into the container scoop and scraper. FIG. 5 emphasizes the asymmetrical complementary structure of the first and second scoops. The first scoop may perform as an extension of the opposing thumb and the second scoop may perform as an extension of the fingers in a prehensile manner to grasp an object or material and pull it into the formed container.

Additional embodiments of the container scoop and scraper comprise at least one of the left and right sides completely perforated to allow only liquids and gasses to enter and leave the container scoop and scraper formed around the enclosed object and/or materials. The container scoop and scraper may also be comprised of a mesh or a screen composition that is completely porous to liquids and completely permeable to gasses. The container scoop and scraper may also be comprised of at least one of a metallic composition, a plastic composition, a ceramic composition, a polystyrene composition, a biodegradable composition and a fiberboard and/or paper composition. Ceramic embodiments may be used in handling very hot objects and materials. Polystyrene embodiments may be used in handling very cold objects and materials.

Figure 6:
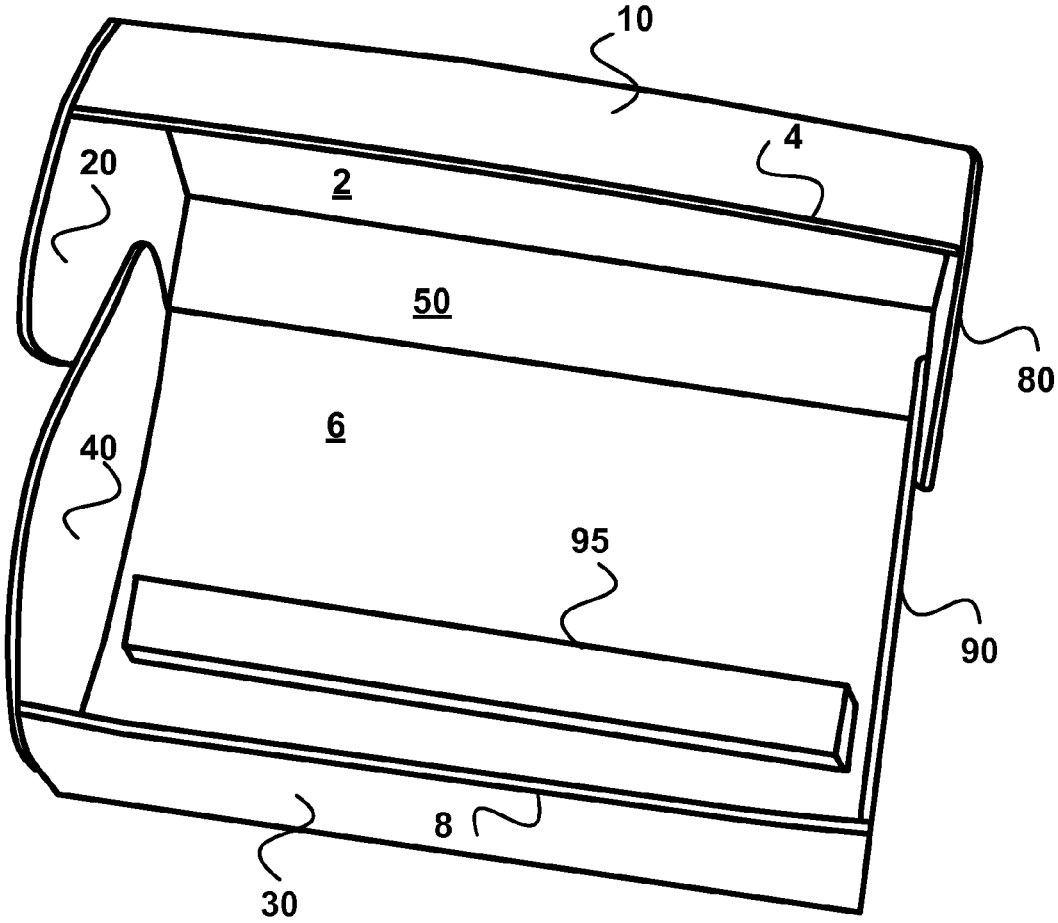
FIG. 6 is a bottom perspective view of the container scoop and scraper in an open position depicting the interior of the container scoop with a magnet attached therein in accordance with an embodiment of the present disclosure.

FIG. 6 is a bottom perspective view of the container scoop and scraper in an open position depicting the interior of the container scoop with a magnet attached therein in accordance with an embodiment of the present disclosure. The magnetic strip 95 is affixed into the second scoop 6 in the depiction but multiple magnetic strips or magnets of various shapes and sizes may also be affixed into the first scoop 2, both scoops and the sides or any combination thereof. The magnetic strip is configured to attract and secure metallic objects and materials grasped by the first and second scoops and collected by the first and second scrapers.

Figure 7:
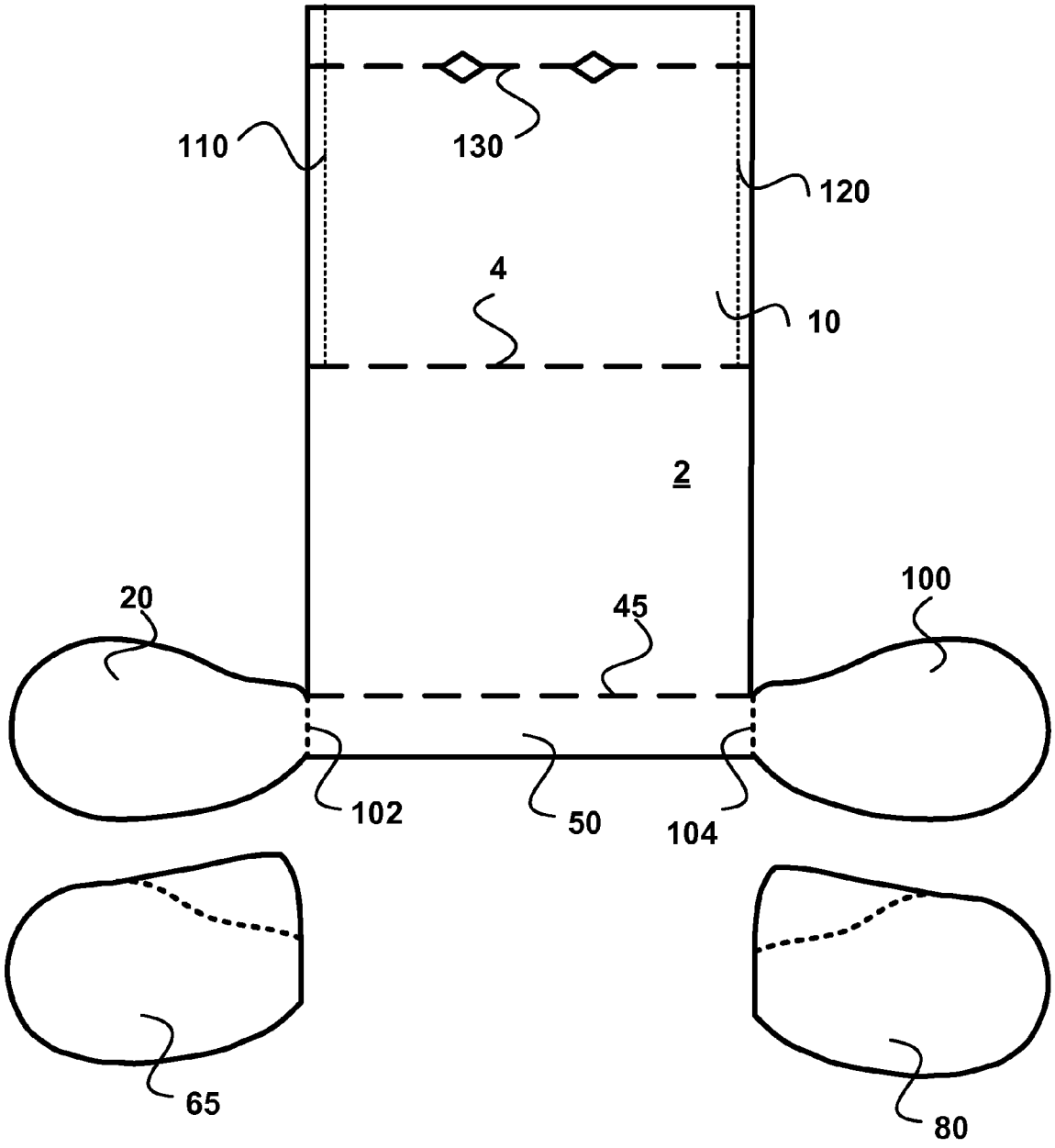
FIG. 7 is a top plan view of a first scoop and scraper before assembly depicting adjoining scoop sides and thumb pocket sides in accordance with an to embodiment of the present disclosure.

FIG. 7 is a top plan view of a first scoop and scraper before assembly depicting adjoining scoop sides and thumb pocket sides in accordance with an to embodiment of the present disclosure. The depiction further includes a first scoop substantially elliptical right side 100, a left side folding edge 102, a right side folding edge 104, a thumb flap left perforation 110, a thumb flap right perforation 120 and a thumb pocket tab 130 fold. The dotted lines on the thumb pocket left and right sides 65 and 80 respectively indicate placement over the first scoop left and right sides 20 and 100. The dotted line 45 is the thumb pocket spine fold and the dotted line 4 is the first scraper when folded in accordance with FIG. 9 below. The dotted line 130 becomes a thumb tab when folded 180 degrees due to the two diamond shaped holes. Dotted lines 102 and 104 are folding edges adjoining the sides to the spine 50. The left and right thumb flap perforations allow a portion of the thumb pocket to be separated from the pocket as illustrated and explained below with respect to FIGS. 11, 12 and 13.

Figure 8:
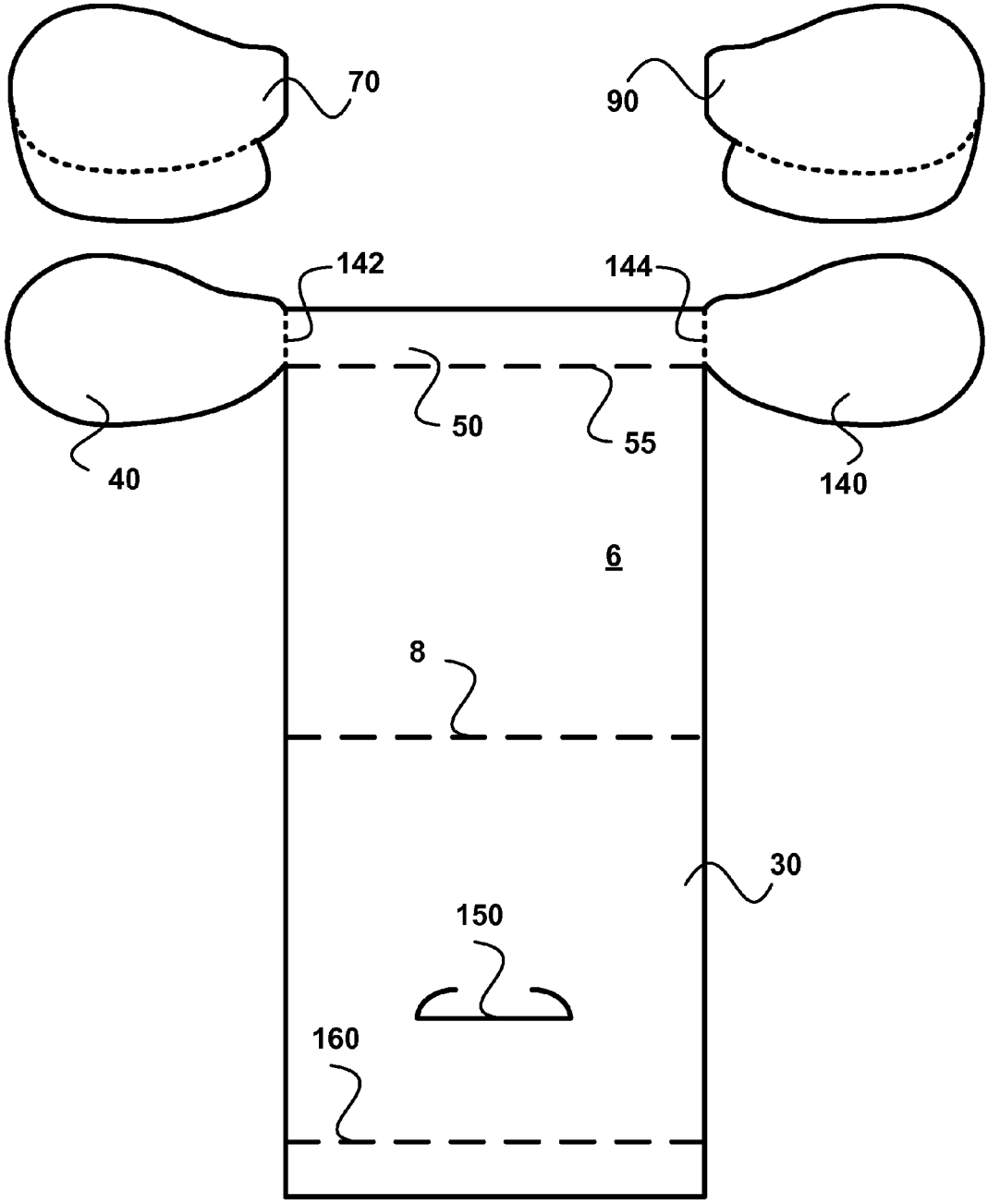
FIG. 8 is a top plan view of the second scoop before assembly depicting scoop sides and finger pocket sides in accordance with an embodiment of the present disclosure.

FIG. 8 is a top plan view of the second scoop before assembly depicting scoop sides and finger pocket sides in accordance with an embodiment of the present disclosure. The depiction further includes a second scoop substantially elliptical right side 140, a left side folding edge 142, a right side folding edge 144, a sacrificial spine 146, a finger pocket notch 150 and a finger insertion edge 160. The dotted lines on the fingers pocket left and right sides 70 and 90 respectively indicate placement over the second scoop left and right sides 40 and 140. The dotted line 55 becomes the hinge and dotted line 8 is the first scraper when folded in accordance with FIG. 10 below. The dotted line 160 becomes the fingers pocket insertion edge when folded 180 degrees. Dotted lines 142 and 144 are folding edges adjoining the sides to the sacrificial hinge 146. The sacrificial spine 146 is later cut at the dotted lines 142 and 144 to adjoin the second scoop and pocket piece to the first scoop and pocket piece at the hinge 55.

Figure 9:
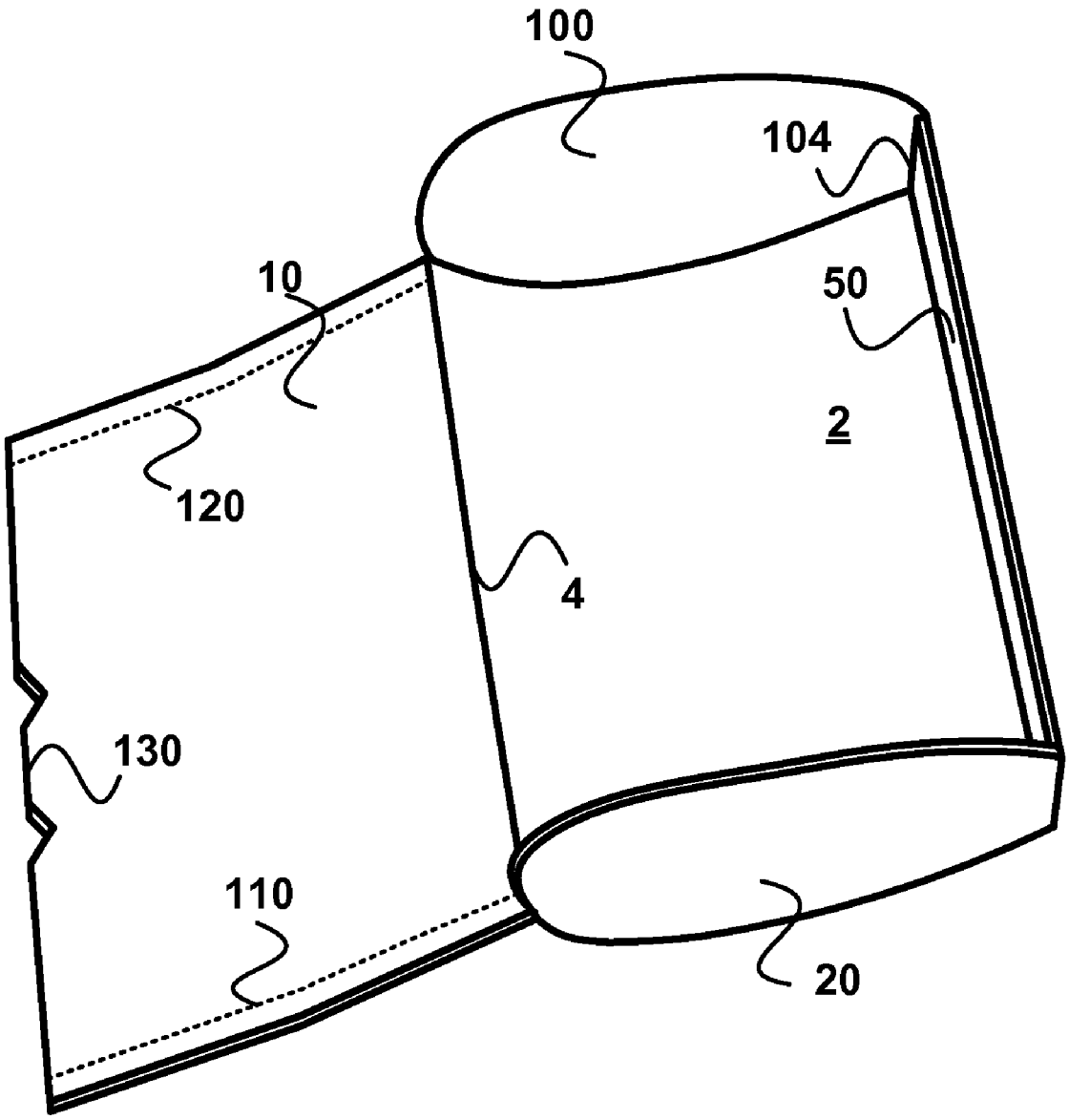
FIG. 9 is a perspective view of a formed first scoop prior to forming the thumb pocket, the first scoop including a tabbed edge in accordance with an embodiment of the present disclosure.

FIG. 9 is a perspective view of a formed first scoop prior to forming the thumb pocket, the first scoop including a tabbed edge in accordance with an embodiment of the present disclosure. FIG. 9 illustrates the formation of the first scoop by folding the sides at line 102 and 104 at substantially 90 degree angles to the spine 50 and adjoining the scoop wall 2 to the scoop sides 20 and 100 in a minor arc. The thumb pocket tab is formed by making a 180 degree fold at the notch line 130. The thumb pocket is not yet formed until adjoined with the thumb to pocket sides. The pocket sides 65 and 80 are undepicted as the pockets are yet unformed.

Figure 10:
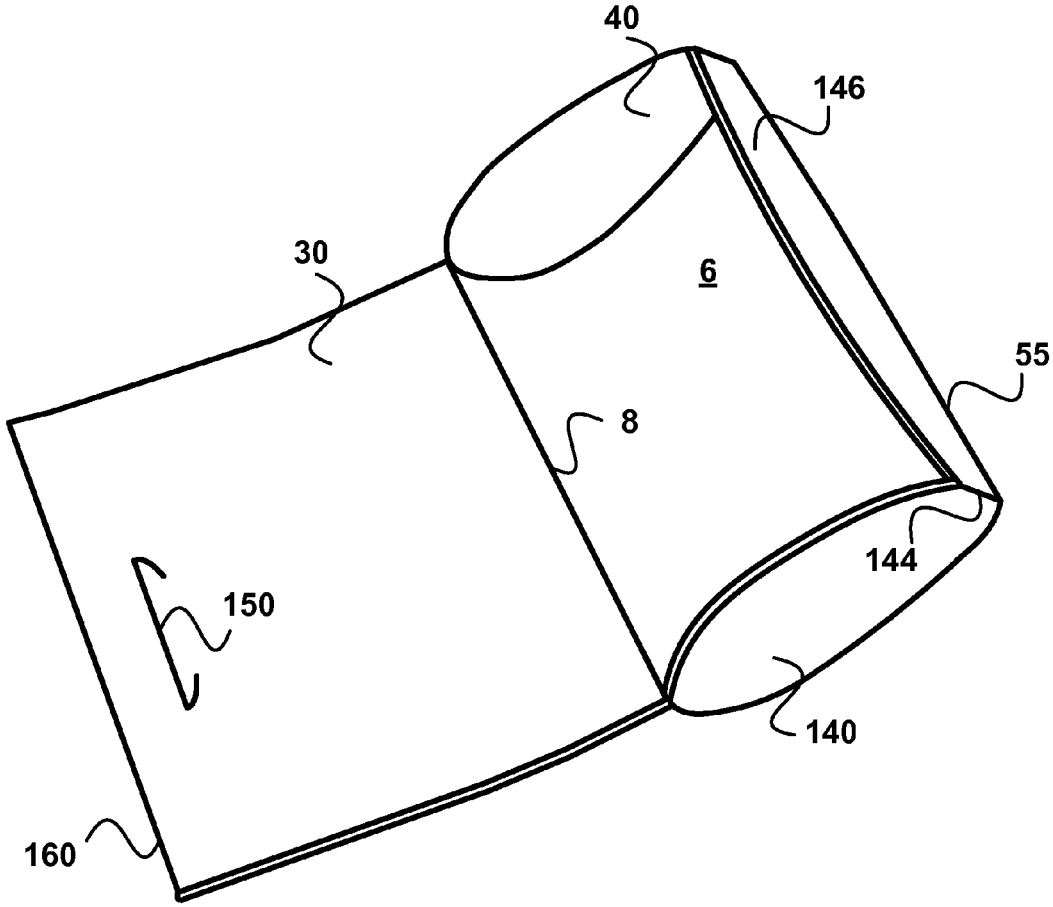
FIG. 10 is a perspective view of a formed second scoop prior to forming the finger pocket, the second scoop including a notch in accordance with an embodiment of the present disclosure.

FIG. 10 is a perspective view of a formed second scoop prior to forming the finger pocket, the second scoop including a notch in accordance with an embodiment of the present disclosure. FIG. 10 illustrates the formation of the second scoop by folding the sides at lines 142 and 144 at substantially 90 degree angles to the sacrificial hinge 146 and adjoining the scoop wall 6 to the scoop sides in a major arc. The fingers pocket insertion edge is formed by making a 180 degree fold at the notch line 160. The fingers pocket is not yet formed until adjoined with the fingers pocket sides 70 and 90 (undepicted). The sacrificial spine 146 is later cut at the dotted lines 142 and 144 to adjoin the second scoop and pocket piece to the first scoop and pocket piece at the hinge 55.

Figure 11:
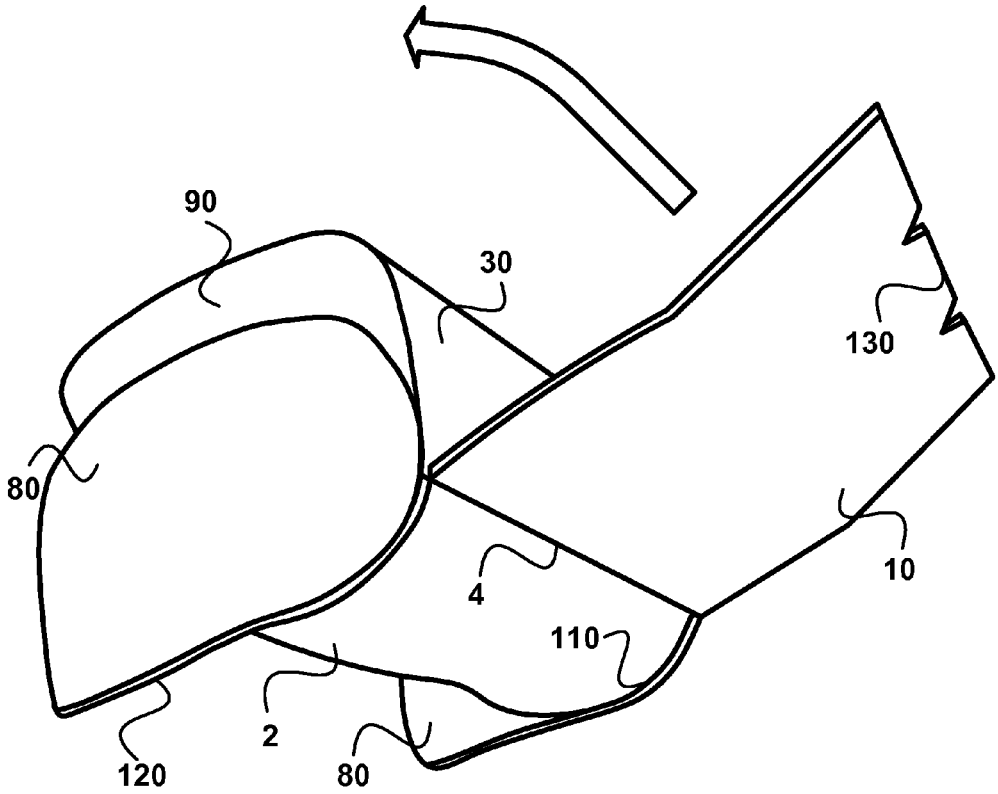
FIG. 11 is a perspective view of a closed container scoop and scraper with a detached thumb pocket flap in accordance with an embodiment of the present disclosure.

FIG. 11 is a perspective view of a closed container scoop and scraper with a detached thumb pocket flap in accordance with an embodiment of the present disclosure. Detaching the thumb pocket flap from the thumb pocket 10 exposes the first scoop 2 wall but preserves the interior intact. The folding edge 4 is also the scraping edge 4. The arrow indicates folding back the flap until it lays against the fingers pocket 30 where it may be secured by placing the tab inside the notch 150. The container scoop and scraper is therefore not only sealed around a grasped object or materials but the first and second scrapers and an outside portion of the scoops that may be contaminated by the grasped object and/or materials are thereby covered.

Figure 12:
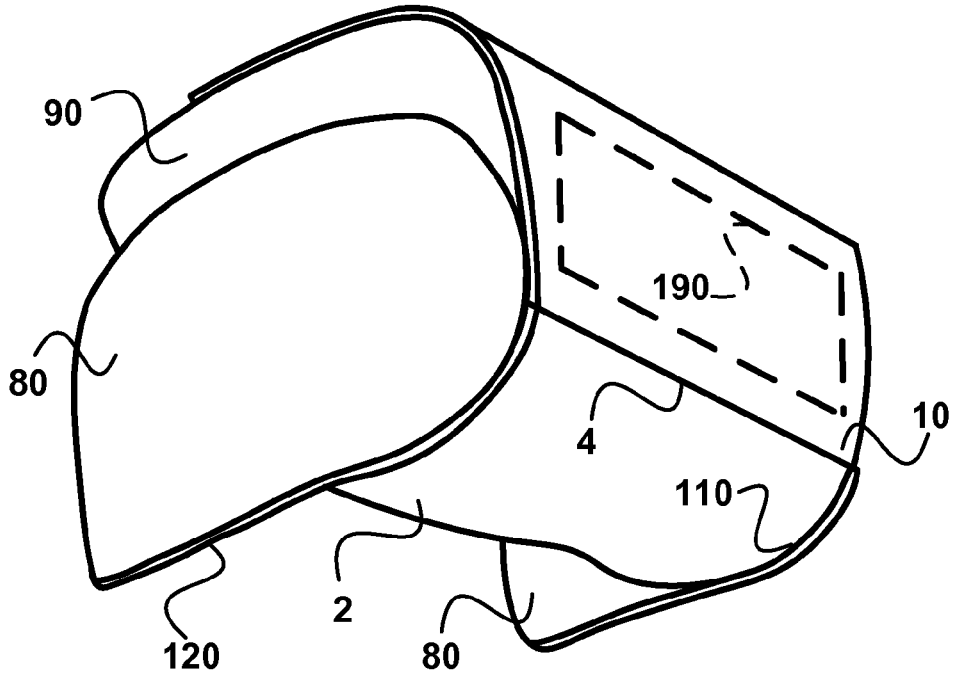
FIG. 12 is a perspective view of a closed and sealed container scoop and scraper with the detached thumb pocket flap folded back over the scrapers and affixed onto the finger pocket in accordance with an embodiment of the present disclosure.

FIG. 12 is a perspective view of a closed and sealed container scoop and scraper with the detached thumb pocket flap folded back over the scrapers and affixed onto the finger pocket in accordance with an embodiment of the present disclosure. In an alternative embodiment, an adhesive strip 60 disposed on an outside portion of the fingers pocket 30 may be used to secure and seal the thumb pocket flap against the fingers pocket 30 with the same properties as discussed above in relation to the tab and notch 150.

Embodiments of the container scoop and scraper may include a portion thereof or multiple portions comprising a temporarily window to a content of the formed container. The window itself may be comprised of at least one of a transparent material with a light polarizing agent or an activated dye or a covering of an opened window. FIG. 12 depicts a temporary transparent window 190 (dotted line) placed on the bottom of the fingers pocket that is covered by the thumb pocket flap. The temporary window may be placed anywhere on the container scoop and scraper and may also comprise whole sections of the device such as the complete first scoop and thumb pocket and sides. The temporary window may allow the user to view the object or material during scraping and gathering. Later, due to a stimulus such as sun or water exposure or a temperature change the window may become opaque and inhibit viewing the contents of the device. As depicted in FIG. 12 the window may also be simply covered and thus prevent viewing the contents of the device. This embodiment facilitates storing and shipping and handling where it is desirable to keep the contents confidential. However, the temporary window properties may also be reversed in situations where it is not desirable to view the object or materials of interest during scraping and gather but only during storage and shipping and handling.

Figure 13:
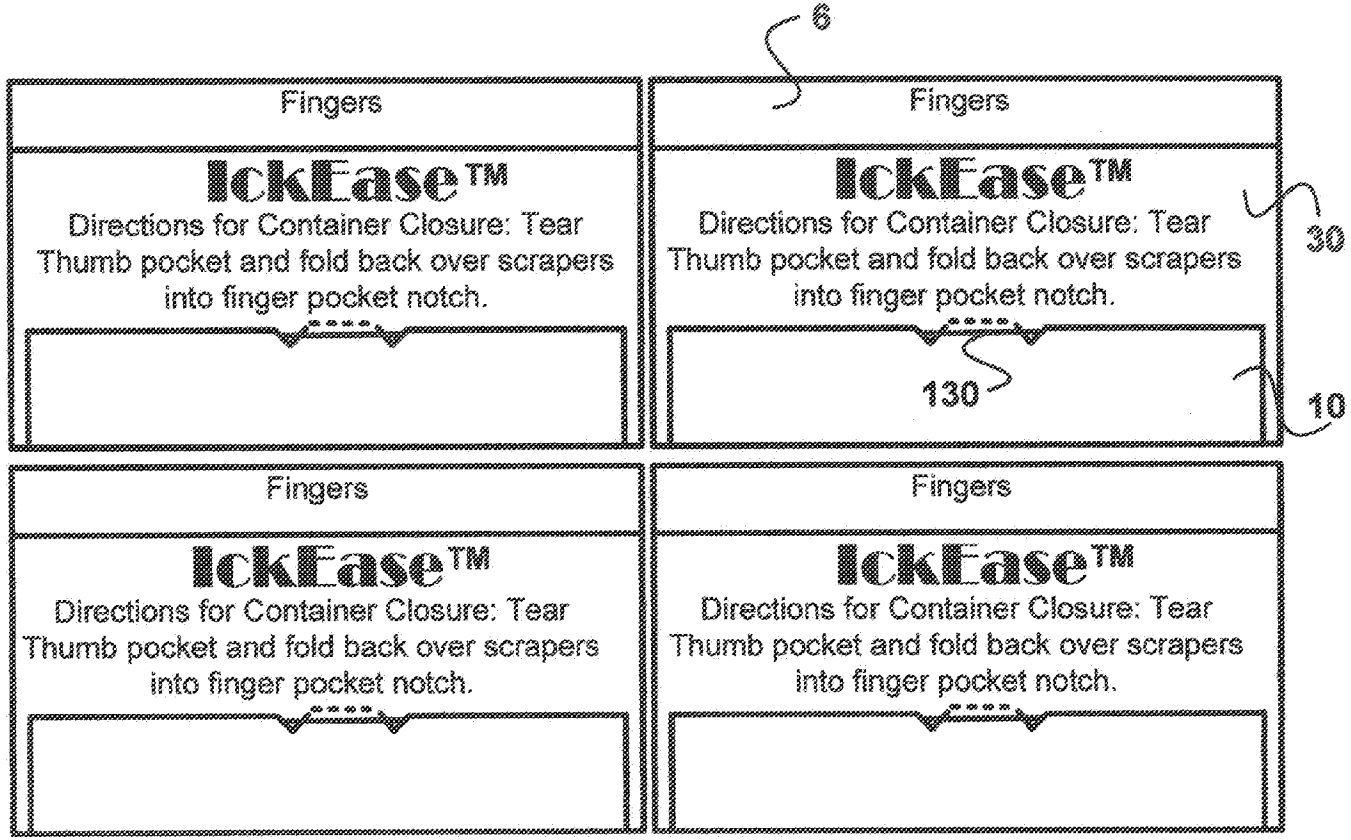
FIG. 13 is a side elevational view of four each closed and sealed container scoop and scraper devices stacked against and on top of each other in accordance with an embodiment of the present disclosure.

FIG. 13 is a side elevational view of four each closed and sealed container scoop and scraper devices stacked against and on top of each other in accordance with an embodiment of the present disclosure. Embodiments thus depicted may comprise at least one of a display of instructions for the efficient and proper use of the container scoop and scraper, a display of advertisements, identification and other indicia for use during shipping and storage as a container. The instructions, advertisements, identification and other indicia may be imprinted on or affixed to the substantially flat exterior surfaces on the thumb and fingers pockets and on the first and second left and right sides. Directions for use may include directions for sealing the container scoop and scraper including, "Directions for Container Sealing: Tear thumb pocket and fold back over scrapers into finger pocket notch."

Figure 14:
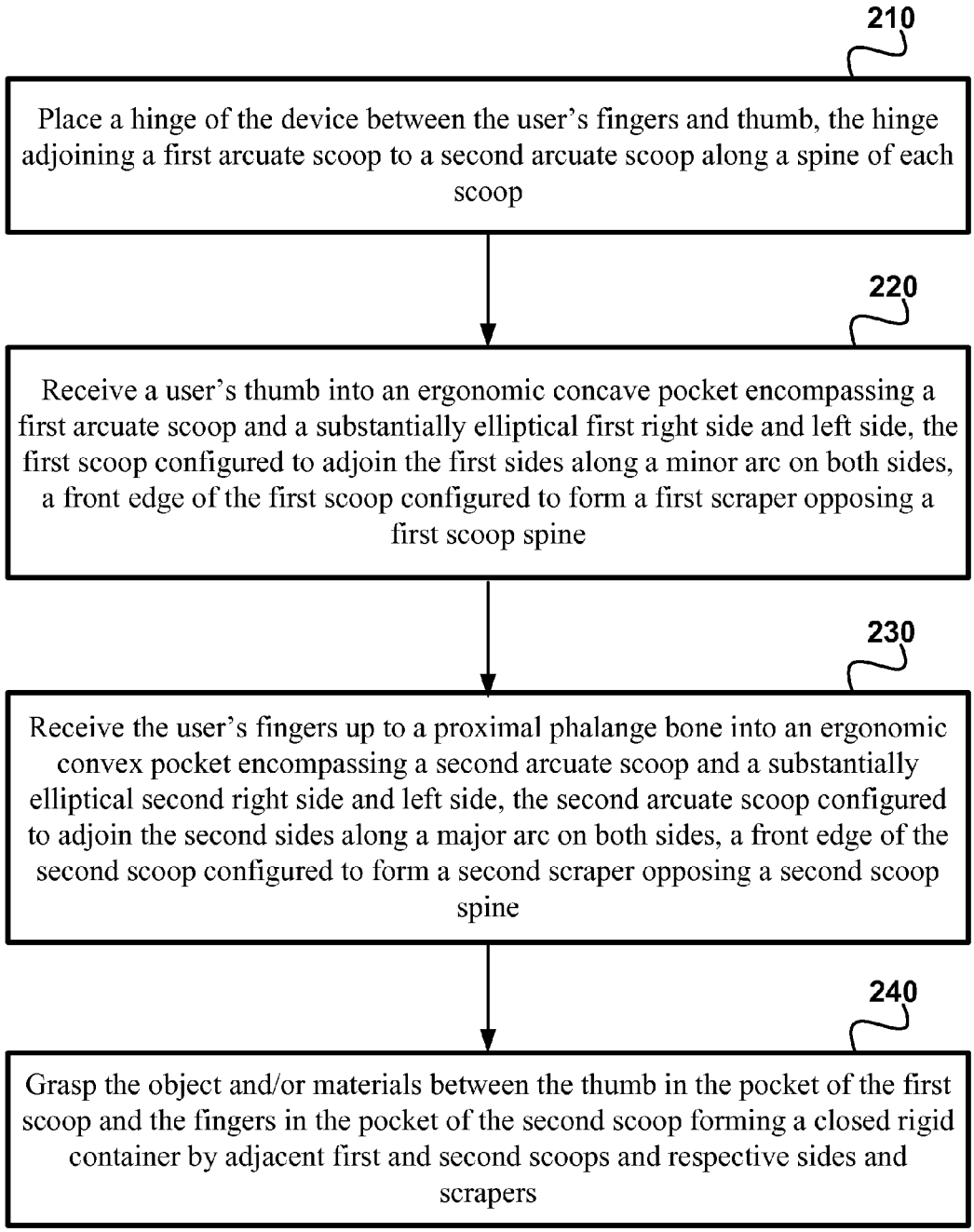
FIG. 14 is a flow chart of a method of using a scraping and scooping device forming a container around an object and/or materials grasped between a user's fingers and opposing thumb of one hand in accordance with an embodiment of the present disclosure.

FIG. 14 is a flow chart of a method of using a scraping and scooping device forming a container around an object and/or materials grasped between a user's fingers and opposing thumb of one hand in accordance with an embodiment of the present disclosure. The method includes placing 210 a hinge of the device between the user's fingers and thumb, the hinge adjoining a first arcuate scoop to a second arcuate scoop along a spine of each scoop.

The method also includes receiving 220 the user's thumb into an to ergonomic concave pocket encompassing a first arcuate scoop and a substantially elliptical first right side and a substantially elliptical first left side, the first scoop configured to adjoin the first right side to the first left side along a minor arc on both sides, a front edge of the first scoop configured to form a first scraper opposing the first scoop spine;

The method additionally includes receiving 230 the user's fingers up to a proximal phalange bone into an ergonomic convex pocket encompassing a second arcuate scoop and a substantially elliptical second right side and a substantially elliptical second left side, the second arcuate scoop configured to adjoin the second right side to the second left side along a major arc on both sides, a front edge of the second scoop configured to form a second scraper opposing the second scoop spine.

The method further includes grasping 240 the object and/or materials between the thumb in the pocket of the first scoop and the fingers in the pocket of the second scoop forming a closed rigid container by adjacent first and second scoops and respective sides and scrapers.

Embodiments of the disclosed method of use may also include scraping the first scraper and the second scraper in an open position across a surface to gather a first object and/or a portion of the material into the second scoop, closing the first scraper against the second scraper to push the first object and/or material portion further into the second scoop and reopening the device with one hand to gather an additional object and/or material without an egress of the first object and/or material to minimize contamination from the objects and/or materials to the scrapers and the outside of the device.

Another embodiment of the disclosed method of use may include opening the container scooping and scraping device with one hand by stretching all four fingers outward from the palm between the arcuate second scoop and the convex fingers pocket, stretching the opposing thumb outward from the palm between the arcuate first scoop and the concave thumb pocket and sliding the thumb laterally within the thumb pocket to a natural ergonomic angle unopposing the fingers.

Figure 15:
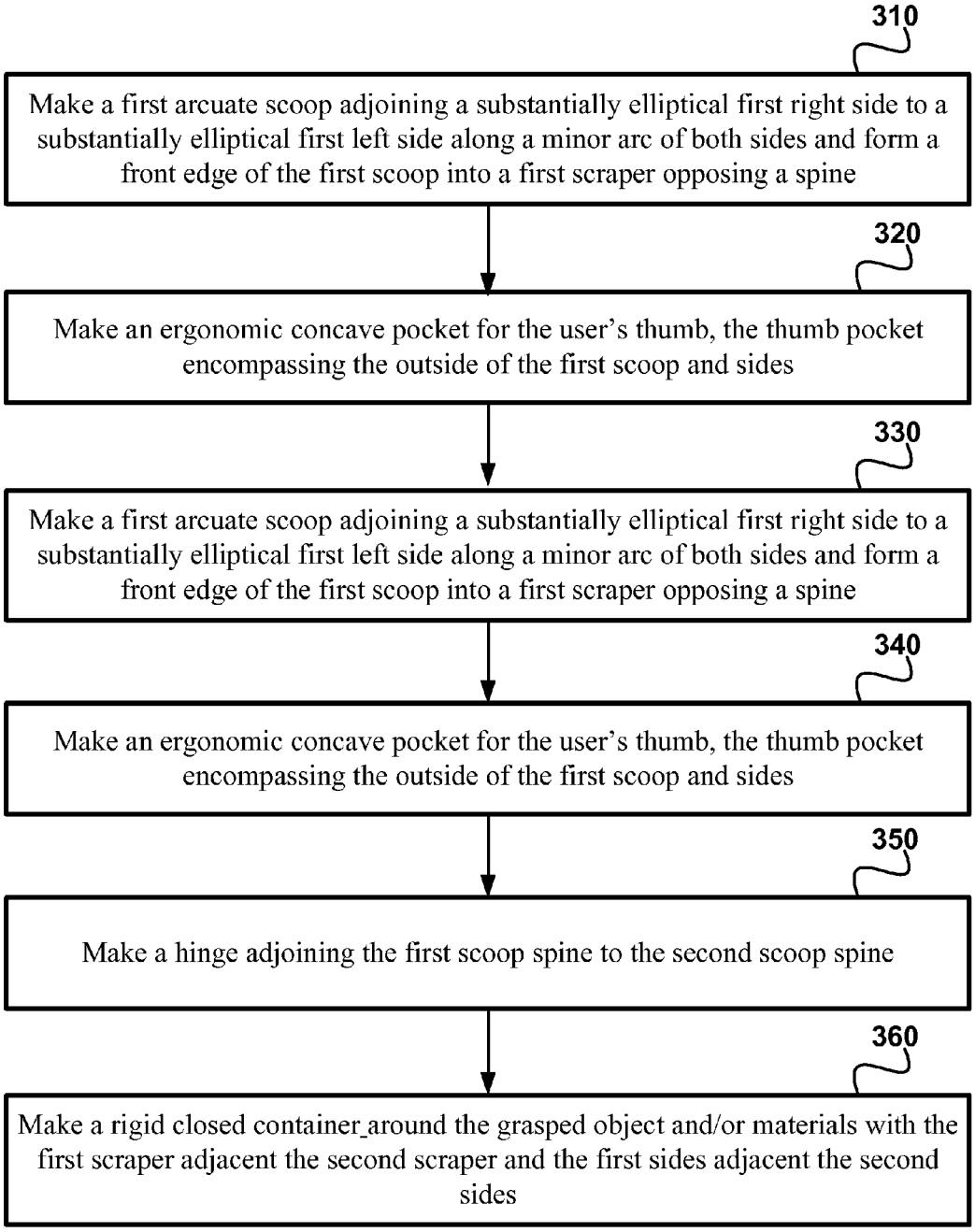
FIG. 15 is a flow chart of a method of making a container around an object and/or materials grasped between a user's fingers and opposing thumb of one hand in accordance with an embodiment of the present disclosure.

FIG. 15 is a flow chart of a method of making a container around an object and/or materials grasped between a user's fingers and opposing thumb of one hand in accordance with an embodiment of the present disclosure. The method includes making a first arcuate scoop 310 adjoining a substantially elliptical first right side to a substantially elliptical first left side along a minor arc of both sides and making a front edge of the first scoop into a first scraper opposing a spine. The method also comprises making an ergonomic concave pocket 320 for the user's thumb, the thumb pocket encompassing the outside of the first scoop and sides.

The method also includes making a second arcuate scoop 330 adjoining a substantially elliptical second right side to a substantially elliptical second left side along a major arc of both sides and making a front edge of the second scoop into a second scraper opposing a spine. The method also comprises making an ergonomic convex pocket 340 for the user's fingers, the fingers pocket encompassing the second scoop and sides.

The method further includes making a hinge 350 adjoining the first scoop spine to the second scoop spine, and making a rigid closed container 360 around the grasped object and/or materials with the first scraper adjacent the second scraper and the first sides adjacent the second sides.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

While the forgoing examples are illustrative of the principles of the present disclosure in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the disclosure be limited, except as by the specification and claims set forth herein.

What is claimed is:

1. A scoop and scraper operable by a user's fingers and opposing thumb of one hand to form a container around a grasped object and/or materials, comprising:

a) a first elliptical scoop configured to adjoin a substantially elliptical right side to a substantially elliptical left side along a minor arc on both sides, a front edge of the first scoop configured to form a first scraper;

b) an ergonomic concave pocket to receive the user's thumb, the thumb pocket configured to encompass the outside of the first scoop and sides;

c) a second elliptical scoop configured to adjoin a substantially elliptical right side to a substantially elliptical left side along a major arc on both sides, a front edge of the second scoop configured to form a second scraper;

d) an ergonomic convex pocket to receive the user's fingers, the fingers pocket configured to encompass the outside of the second scoop and sides; and e) a hinge configured to adjoin the first scoop to the second scoop and to dispose the first scoop left and right sides adjacent the second scoop left and right sides to form a closed rigid container around the grasped object and/or materials.

2. The container scoop and scraper of claim 1, further comprising:

a) an adhesive seal disposed on an outside portion of the convex pocket; and b) a detachable portion of the concave pocket configured to lay back against the convex pocket and the adhesive seal to seal the container scoop and scraper around a grasped object and to cover the first and second scrapers and an outside portion of the second scoop that may be contaminated by the grasped object and/or materials.

3. The container scoop and scraper of claim 1, further comprising a magnetic strip disposed on the inside of at least one of the first and second scoops, the magnetic strip configured to attract and secure metallic objects and/or materials grasped by the first and second scoops and collected by the first and second scrapers.

4. The container scoop and scraper of claim 1, wherein the left and right sides of both scoops are configured to be adjacent and overlap.

5. The container scoop and scraper of claim 1, further comprising a display of instructions for the efficient and proper use of the container scoop and scraper, the instructions imprinted on and/or affixed to a plurality of substantially flat exterior surfaces on the pockets and on the first and second left and right sides.

6. The container scoop and scraper of claim 1, wherein the container scoop and scraper is comprised of at least one of a metallic composition, a plastic composition, a ceramic composition, a polystyrene composition, a biodegradable composition and a fiberboard and/or paper composition.

7. The container scoop and scraper of claim 1, wherein the concave pocket and the convex pocket each comprise a plurality of stackable external surfaces to enable stacking a plurality of closed container scoops.

* * * * *